United States Patent [19]

Katoh

[11] Patent Number: 4,839,258

[45] Date of Patent: Jun. 13, 1989

[54] SUPER-HIGH CONTRAST NEGATIVE TYPE PHOTOGRAPHIC MATERIAL CONTAINING HYDRAZINE AND A REDUCTONE

[75] Inventor: Kazunobu Katoh, Ashigara, Japan

[73] Assignee: Fuji Photo Film Co., Ltd., Kanagawa, Japan

[21] Appl. No.: 36,753

[22] Filed: Apr. 8, 1987

[30] Foreign Application Priority Data

Apr. 8, 1986 [JP] Japan ..... 61-80636

[51] Int. Cl.[4] ..... G03C 1/28; G03C 1/06

[52] U.S. Cl. ..... 430/264; 430/947

[58] Field of Search ..... 430/264, 949

[56] References Cited

U.S. PATENT DOCUMENTS 4,053,318 10/1977 Sato et al. ..... 430/591

4,243,739 1/1981 Mifune et al. ..... 430/567

OTHER PUBLICATIONS

James, The Theory of the Photographic Process, (4th Ed.) pp. 304, 313, 150, 151, 152.

*Primary Examiner*—Paul R. Michl

*Assistant Examiner*—Patrick A. Doody

*Attorney, Agent, or Firm*—Sughrue, Mion, Zinn, Macpeak & Seas

[57] ABSTRACT

A super-high contrast negative type silver halide photographic material is disclosed, comprising a support having provided thereon at least one silver halide emulsion layer, said emulsion layer or layers or other hydrophilic colloidal layer or layers containing a hydrazine derivative, wherein said photographic material further contains a compound selected from reductones and at least one compound represented by formula (I) or (II)

(I)

(II)

wherein $X_1$ represents a halogen atom, an N-methylolamino group, or a glycidoxy group; $Y_1$ and $Z_1$ each represents a hydrogen atom, a halogen atom, a hydroxyl group, —OM (wherein M represents an alkali metal ion), a substituted or unsubstituted amino group, an alkyl ether group, a phenyl ether group, an alkyl thioether group, a phenyl thioether group, a sulfonamide group, or an alkylsulfonamide group.

The photographic material exhibits high sensitivity and high contrast without forming black spots, even when processed with a stable developer, and also exhibits high mechanical film strength.

18 Claims, No Drawings

SUPER-HIGH CONTRAST NEGATIVE TYPE PHOTOGRAPHIC MATERIAL CONTAINING HYDRAZINE AND A REDUCTONE

FIELD OF THE INVENTION

This invention relates to a silver halide photographic material and a method for forming a super-high contrast negative image using the same. More particularly, it relates to a silver halide photographic material useful for the photo-mechanical process and a method for forming a super-high contrast negative image using the same.

BACKGROUND OF THE INVENTION

In the field of graphic arts, in order to obtain satisfactory reproducibility of a dot image having a continuous gradation or a line image, an image formation system having super-high contrast photographic characteristics (particularly as having a gamma of not less than 10) is required.

For this purpose, a special developer referred to as lith developer has been conventionally employed. A lith developer contains hydroquinone as a developing agent, and, as a preservative, sulfite in the form of an adduct with formaldehyde, so as to have the free sulfite ion concentration controlled at an extremely low level, usually not more than 0.1 mol/liter, in order not to inhibit infectious development. Therefore, the lith developer is extremely susceptible to air oxidation and does not withstand preservation for more than 3 days.

Use of hydrazine derivatives has been proposed for obtaining a high contrast with a stable developing solution, as disclosed in U.S. Pat. Nos. 4,224,401, 4,168,977, 4,166,742, 4,311,781, 4,272,606, 4,211,857, 4,243,739, etc. According to this technique, photographic characteristics of super-high contrast and high sensitivity can be achieved, and the stability of the developer to air-oxidation is markedly improved over earlier lith developers because addition of a sulfite to the developer at a high concentration is permissible.

However, the above-described image formation system with high sulfite concentration brings about not only high sensitivity and high contrast, but also an unfavorable phenomenon of black spots, sometimes called black pepper, on non-developed areas between dots due to infection, which has presented a serious problem in photomechanical process. Formation of black spots frequently occurs when a light-sensitive material is preserved, particularly under a high temperature and high humidity condition, or when a developer undergoes fatigue with time, which generally involves decrease in sulfite ions used as preserative or increase in PH, resulting in considerable reduction of commercial value as a light-sensitive material for photomechanical process. Although many efforts have been made to overcome this problem, conventionally proposed techniques for eliminating black spots are often accompanied by reduction of sensitivity and gamma. Therefore, it has been keenly desired to develop a system free from black spots while retaining high sensitivity and high contrast.

It has been proved effective for this purpose to add reductones to light-sensitive materials. However, addition of reductones has also been turned out to cause several disadvantages, such as retardation of gelatin hardening in a coating film and reduction in mechanical strength of a coating film, resulting in liability to scratches during development, fixing, and washing.

SUMMARY OF THE INVENTION

One object of the present invention is to provide a silver halide photographic material which exhibits high sensitivity and high contrast, having a gamma value exceeding 10, when processed with a stable developer, without forming black spots.

Another object of the present invention is to provide a silver halide photographic material which does not form black spots and exhibits high mechanical strength.

It has now been found that the above objects can be accomplished by a super-high contrast negative type silver halide photographic material comprising a support having provided thereon at least one silver halide emulsion layer, said emulsion layer or layers or other hydrophilic colloidal layer or layers containing a hydrazine derivative, wherein said material further contains a compound selected from reductones and at least one compound represented by formula (I) or (II) shown below.

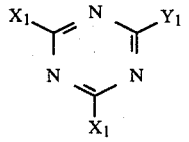

(I)

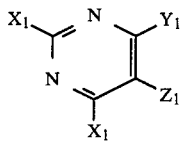

(II)

wherein $X_1$ represents a halogen atom, an N-methylolamino group, or a glycidoxy group; $Y_1$ and $Z_1$ (which may be the same or different) each represents a hydrogen atom, a halogen atom, a hydroxyl group, —OM (wherein M represents an alkali metal ion), an unsubstituted amino group, a substituted amino group, an alkyl ether group, a phenyl ether group, an alkyl thioether group, a phenyl thioether group, a sulfonamide group, or an alkylsulfonamide group.

DETAILED DESCRIPTION OF THE INVENTION

Hydrazine derivatives which can be used in the present invention include hydrazine derivatives having a sulfinyl group as described in U.S. Pat. No. 4,478,928 and compounds represented by formula (III) shown below.

Formula (III) is represented by $$R_0\text{—NHNH—CHO} \qquad \text{(III)}$$

wherein $R_0$ represents an aliphatic group or an aromatic or heterocyclic group.

In formula (III), the aliphatic group represented by $R_0$ preferably represents a substituted or unsubstituted straight or branched chain or cyclic alkyl group having from 1 to 30 carbon atoms, and more preferably from 1 to 20 carbon atoms. The branched alkyl group may be cyclized to form a saturated hetero ring containing at least one hetero atom. The substituents for the alkyl group include an aryl group, an alkoxy group, a sulfoxy group, a sulfonamide group, a carbonamido group, etc.

Specific examples of the alkyl group for $R_0$ include a t-butyl group, an n-octyl group, a t-octyl group, a cyclohexyl group, a pyrrolidyl group, an imidazolyl group, a tetrahydrofuryl group, a morpholino group, and the like.

The aromatic or heterocyclic group as represented by $R_0$ is a substituted or unsubstituted monocyclic or bicyclic aryl or a substituted or unsubstituted unsaturated heterocyclic group. The unsaturated heterocyclic group may be condensed with a monocyclic or bicyclic aryl group to form a heteroaryl group.

A particularly preferred group represented by $R_0$ in formula (III) is an aryl group.

Specific examples of the aromatic or heterocyclic group include a benzene ring, a naphthalene ring, a pyridine ring, a pyrimidine ring, an imidazole ring, a pyrrazole ring, a quinoline ring, an isoquinoline ring, a benzimidazole ring, a thiazole ring, a benzothiazole ring, etc. Of these, those containing a benzene ring are preferred.

The aryl group, or the aromatic or heterocyclic group represented by $R_0$ may have one or more substituents.

Typical substituents for the aromatic or heterocyclic group include a straight or branched chain or cyclic alkyl group (preferably having from 1 to 20 carbon atoms), an aralkyl group (preferably comprising a monocyclic or bicyclic aryl moiety and an alkyl moiety having from 1 to 3 carbon atoms), an alkoxy group (preferably having from 1 to 20 carbon atoms), a substituted amino group (preferably substituted by an alkyl group having from 1 to 20 carbon atoms), an acylamino group (preferably having from 2 to 30 carbon atoms), a sulfonamide group (preferably having from 1 to 30 carbon atoms), a ureido group (preferably having from 1 to 30 carbon atoms), and the like.

A particularly preferred example of substituents is an acylamino group, a sulfonamide group, or a ureido group.

The aliphatic or aromatic or heterocyclic group as represented by $R_0$ may have incorporated therein a ballast group commonly employed in immobile photographic additives, such as couplers. The ballast group is selected from those groups that contain 8 or more carbon atoms and are relatively inert to photographic characteristics, such as an alkyl group, an alkoxy group, a phenyl group, an alkylphenyl group, a phenoxy group, an alkylphenoxy group, or the like.

The aliphatic, or aromatic or heterocyclic group as represented by $R_0$ may further have incorporated therein a group enhancing adsorption onto surface of silver halide grains. Such an adsorptive group includes a thiourea group, a heterocyclic thioamido group, a mercapto heterocyclic group, a triazole group, etc., as described in U.S. Pat. No. 4,385,108.

Methods of synthesizing the compounds of formula (III) are described, e.g., in U.S. Pat. Nos. 4,168,977, 4,224,401, 4,171,977, and 4,323,643.

The hydrazine derivative which can be used in the present invention is preferably incorporated in a silver halide emulsion layer, but may be incorporated in any other light-insensitive hydrophilic colloidal layers, such as a protective layer, an interlayer a filter layer, an antihalation layer, and the like. Incorporation of the compound (III) can be carried out by dissolving it in water in case of using a water-soluble compound or in a water-miscible organic solvent, e.g., alcohols, esters, ketones, etc., in case of using a sparingly water soluble compound, and adding the solution to a hydrophilic colloid solution. When it is added to a silver halide emulsion layer, addition may be effected at any stage of from the commencement of chemical ripening up to the stage immediately before coating, and preferably from the end of chemical ripening to the stage before coating. In particular, the compound is preferably added to a coating composition ready to be coated.

The amount of the compound of formula (III) to be added is desirably selected so as to obtain best results according to the grain size and halogen composition of silver halides, the method and degree of chemical sensitization, the relation between the layer to which the compound is added and a silver halide emulsion layer, the kind of antifoggant used, and the like. Such selection is conventional for one skilled in the art. Usually, the compound is formula (III) is preferably used in an amount of from $1\times10^{-6}$ to $1\times10^{-1}$ mol, and more preferably from $1\times10^{-5}$ to $4\times10^{-2}$ mol, per mol of silver halide.

Specific but non-limitative examples of the compounds represented by formula (III) are shown below.

III-1

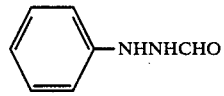

III-2

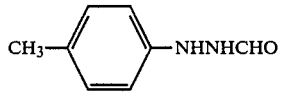

III-3

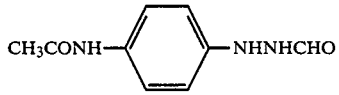

III-4

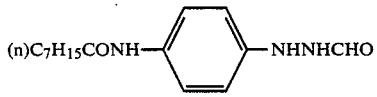

-continued
III-5
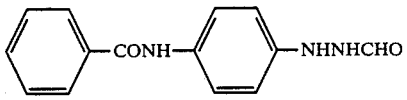
III-6
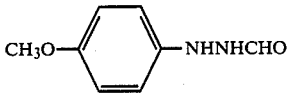
III-7
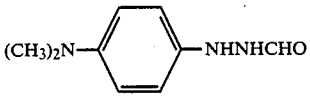
III-8
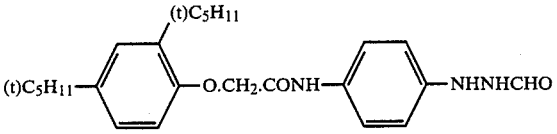
III-9
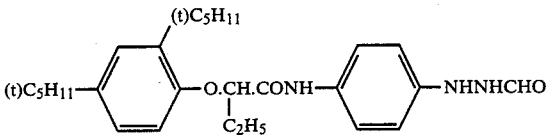
III-10
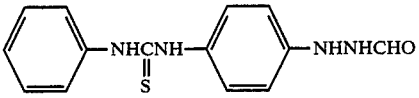
III-11
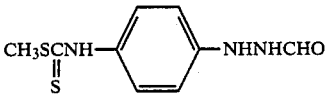
III-12
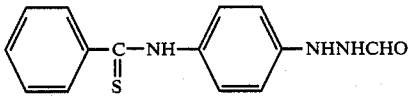
III-13
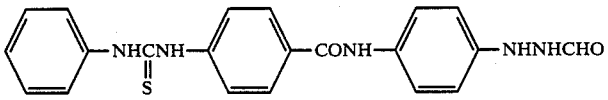
III-14
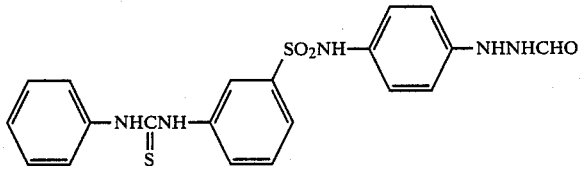
III-15
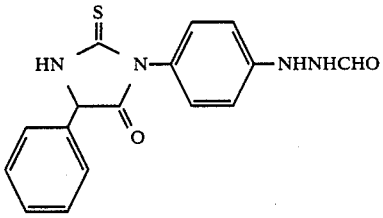

-continued
III-16
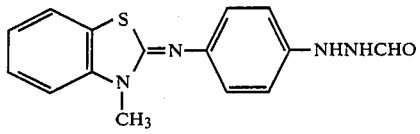
III-17
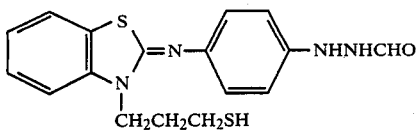
III-18
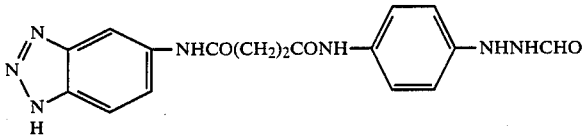
III-19
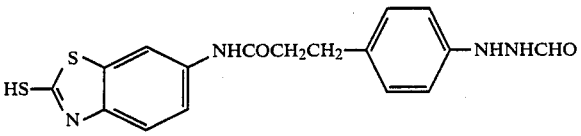
III-20
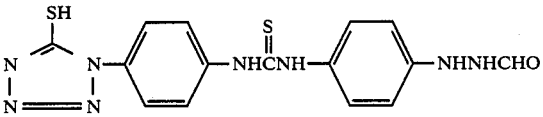
III-21
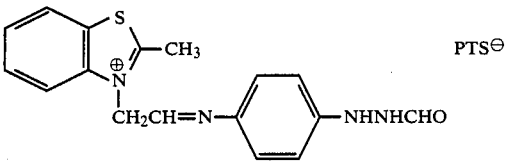
III-22
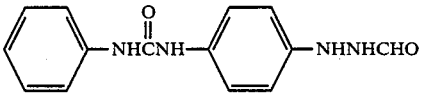
III-23
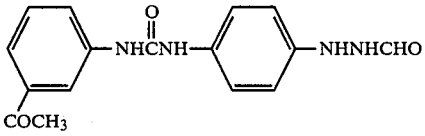
III-24
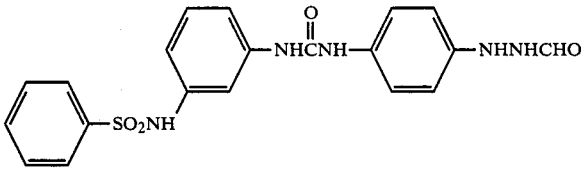
III-25
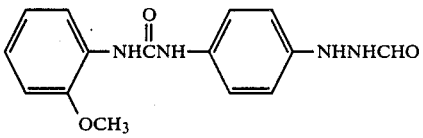

-continued

III-26

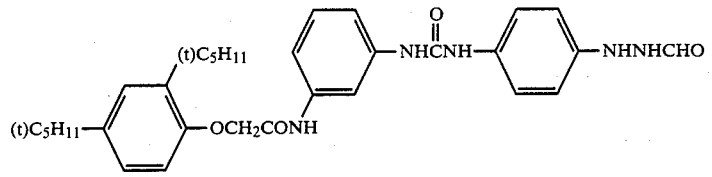

III-27

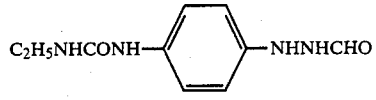

III-28

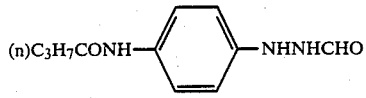

III-29

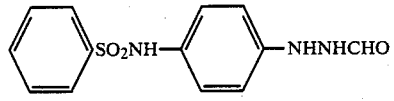

III-30

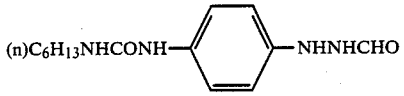

III-31

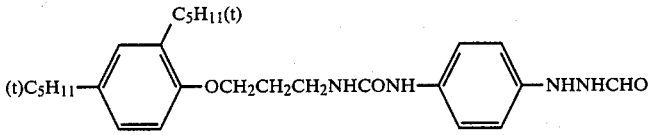

III-32

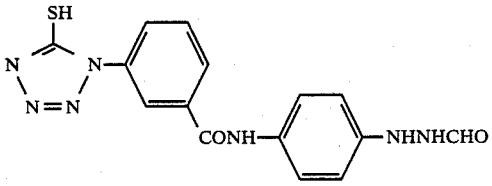

III-33

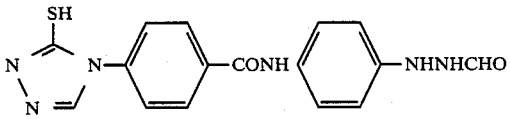

*PTS⊖: para-toluene sulfonate ion

Specific examples of the hydrazine derivatives disclosed in U.S. Pat. No. 4,478,928 which can also be used in the present invention are shown below.

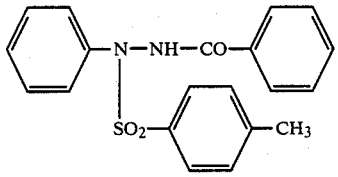

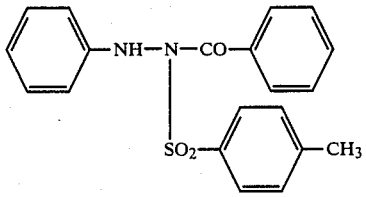

-continued

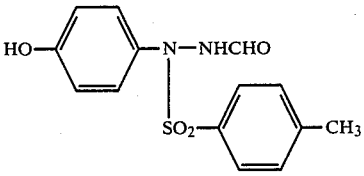

The reductones which can be used in the present invention are conventional and include an endiol type, a thiol-enol type, an enaminol type, an endiamine type, and an enamine-thiol type. Specific examples of these compounds and syntheses thereof are well known as described, e.g., in N. Nomura and H. Ohmura, *Reductone no Kagaku,* Uchidarokakuhoshinsha (1969).

Preferred among these reductones are 3-carbonylendiol compounds represented by formula (IV) shown below and amino-reductones represented by formula (V) shown below, and imino-reductones represented by formula (VI) shown below.

Formula (IV) is represented by

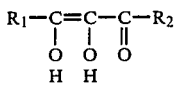

(IV)

wherein $R_1$ and $R_2$ each represents an unsubstituted alkyl group (preferably having from 1 to 6 carbon atoms), a substituted alkyl group (preferably having from 1 to 6 carbon atoms) substituted with a hydroxyl group, an alkoxy group, an aryl group, a carboxyl group, an amino group, an imino group, etc., an allyl group, an unsubstituted aryl group (preferably having from 1 to 12 carbon atoms), or a substituted aryl group (preferably having from 1 to 12 carbon atoms) substituted with a hydroxyl group, an alkoxy group, an aryl group, a carboxyl group, a halogen atom, an amino group, etc., or $R_1$ and $R_2$ are taken together to form a carbon-carbon linkage or a heterocyclic ring containing an oxygen atom, a nitrogen atom, a sulfur atom, etc.

Precursors for the compounds of formula (IV), i.e., alkyl or aryl ethers and esters thereof, which are capable of forming the compounds of formula (VI) may also be used.

Formula (V) is represented by

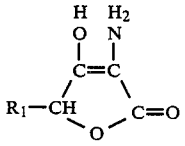

(V)

wherein $R_1$ is the same as defined above.

Formula (VI) is represented by

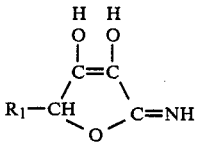

(VI)

wherein $R_1$ is the same as defined above.

Specific examples of the reductones which can be used in the present invention are shown below.

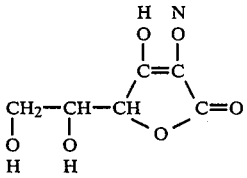

(IV-1)

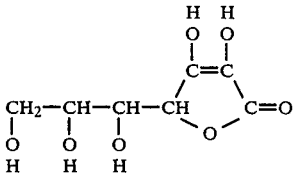

(IV-2)

-continued

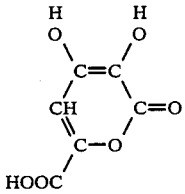

(IV-3)

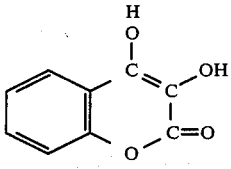

(IV-4)

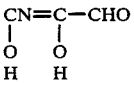

(IV-5)

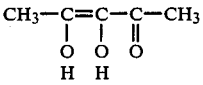

(IV-6)

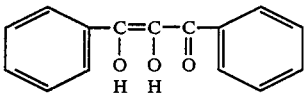

(IV-7)

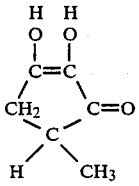

(IV-8)

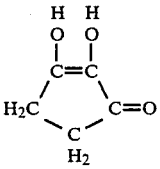

(IV-9)

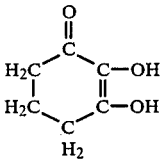

(IV-10)

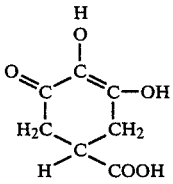

(IV-11)

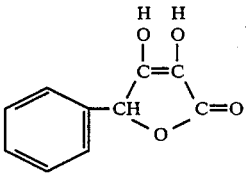

(IV-12)

-continued (IV-13)

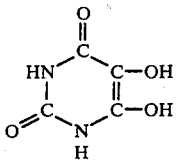

(IV-14)

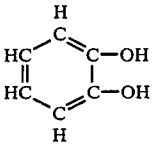

(IV-15)

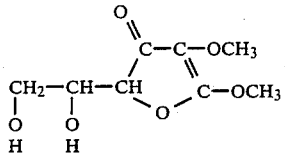

(dimethyl ether of IV-1)

(IV-16)

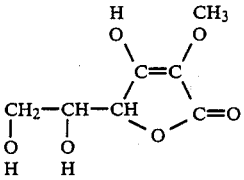

(monomethyl ether of IV-1)

(IV-17)

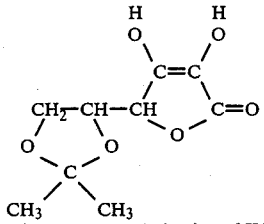

(monoacetone derivative of IV-1)

(IV-18)

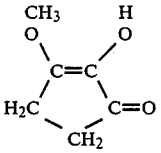

(monomethyl ether of IV-9)

(IV-19)

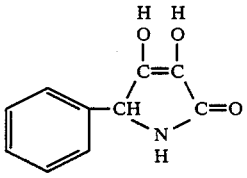

(V-1)

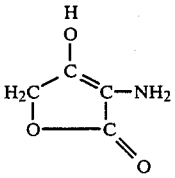

-continued (VI-1)

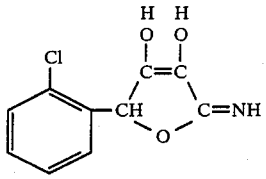

(Other reductones)

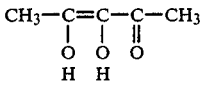

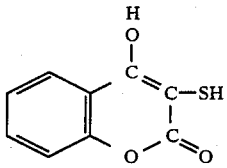

These reductones are preferably used in an amount of from $1.0\times10^{-6}$ to $1.0\times10^{-3}$ mol/m$^2$, and more preferably from $1.0\times10^{-5}$ to $5.0\times10-4$ mol/m$^2$.

The compounds represented by formulae (I) and (II) according to the present invention are further described below.

In formula (II), substituents for the substituted amino group as represented by $Y_1$ and $Z_1$ include a phenyl group, a sulfonated phenyl group, a carboxylated phenyl group, an alkyl group, a sulfonated alkyl group, a carboxylated alkyl group, and a hydroxyalkyl group.

The groups represented by $Y_1$ and $Z_1$ is preferably selected from —OM (wherein M is as defined above) and alkylamino or arylamino groups substituted with a water-soluble group, e.g., a sulfo group, a carboxyl group, etc.

Preferred among the amounts represented by formulae (I) and (II) are those wherein $X_1$ is a chlorine atom.

Specific examples of compounds of formulae (I) and (II) which are preferably used in the present invention are shown below. Of the following compounds, particularly preferred are Compounds (I-1), (I-2), (I-4), and (I-10).

(I-1)

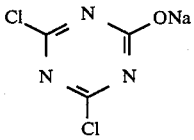

(I-2)

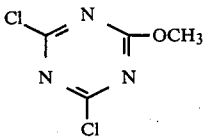

(I-3)

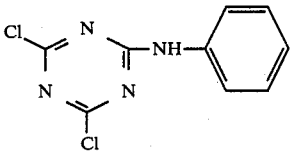

-continued (I-4)

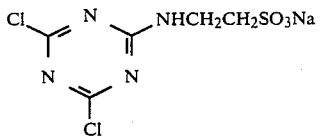

(I-5)

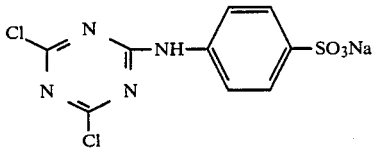

(I-6)

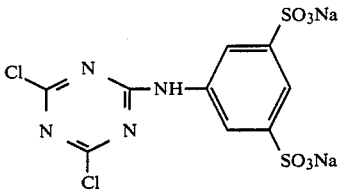

(I-7)

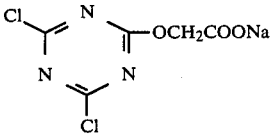

(I-8)

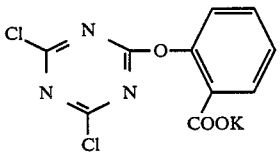

(I-9)

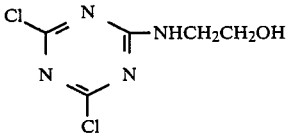

(I-10)

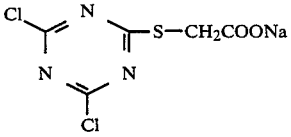

(I-11)

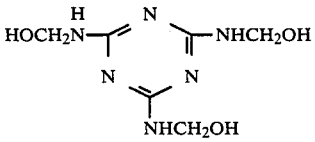

(I-12)

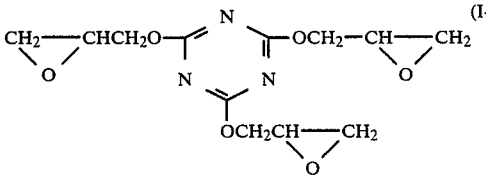

(I-13)

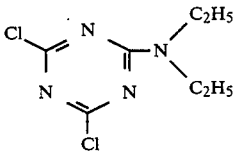

-continued (I-14)

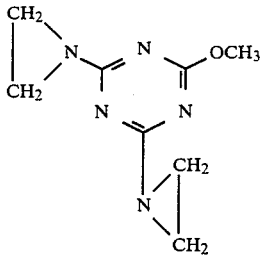

(II-1)

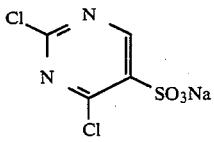

(II-2)

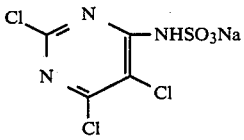

(II-3)

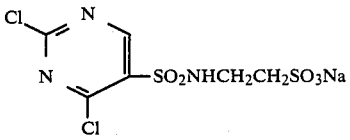

(II-4)

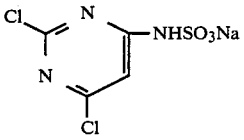

(II-5)

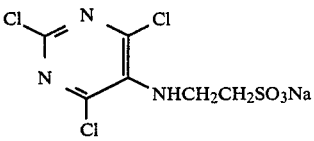

These compounds represented by formula (I) or (II) are preferably used in an amount of from $0.5\times10^{-3}$ to $100\times10^{-3}$ mol, and more preferably from $1.0\times10^{-3}$ to $30\times10^{-3}$ mol, per 100 g of gelatin in a layer.

In combination with the compounds of formulae (I) and (II), compounds having at least two vinylsulfone groups can be used to advantage as a gelatin hardener. Such a vinylsulfone group-containing hardener is represented by formula (VII)

$$CH_2{=}CHSO_2{-}R_3{-}SO_2CH{=}CH_2 \qquad \text{(VII)}$$

wherein $R_3$ represents a divalent linking group, such as an alkylene group and a substituted alkylene group substituted with a halogen atom, a hydroxyl group, a hydroxyalkyl group, or an amino group, etc., which may contain therein an amido linkage, an ether linkage, or a thioether linkage.

Specific examples of the compounds represented by formula (VII) are shown below.

$CH_2{=}CHSO_2CH_2SO_2CH{=}CH_2$ (VII-1)
$CH_2{=}CHSO_2(CH_2)_2SO_2CH{=}CH_2$ (VII-2)
$CH_2{=}CHSO_2(CH_2)_4SO_2CH{=}CH_2$ (VII-3)

-continued $CH_2{=}CHSO_2CH_2COH_2SO_2CH{=}CH_2$ (VII-4)

$CH_2{=}CHSO_2(CH_2)_2O(CH_2)_2SO_2CH{=}CH_2$ (VII-5)

$CH_2{=}CHSO_2CH_2\overset{OH}{\overset{|}{C}}HCH_2SO_2CH{=}CH_2$ (VII-6)

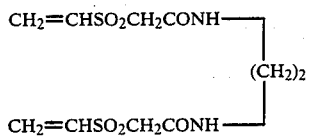

(VII-7)

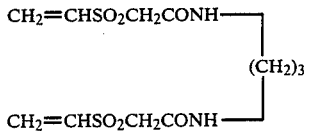

(VII-8)

These compounds represented by formula (VII) are preferably used in an amount of from $1.0\times10^{-3}$ to $100\times10^{-3}$ mol, and more preferably from $3.0\times10^{-3}$ to $30\times10^{-3}$ mol, per 100 g of gelatin in a layer.

It has been found that the compounds of formulae (I) and (II), when used in the presence of reductones, unexpectedly bring about marked improvements on chemical strength of a coating film and also specifically accelerate hardening of gelatin. It was also found, however, that addition of too large an amount of these compounds increases sensitivity variations of a light-sensitive material. In particular, when an exposed light-sensitive material is left to stand under a high humidity condition for a long period of time before it is developed, the light-sensitive material undergoes intensification of the latent image. Such a variation of sensitivity can, surprisingly, be suppressed by the combined use of the compound of formula (VII) and the compound of formula (I) or (II) while maintaining the effects to enhance the mechanical strength of a coating film and to accelerate hardening. In this case, the amount of the compound of formula (I) or (II) to be added preferably ranges from $1.0\times10^{-3}$ to $10\times10^{-3}$ mol per 100 g of gelatin in a layer, and the amount of the compound of formula (VII) to be added preferably ranges from $3.0\times10^{-3}$ to $20\times10^{-3}$ mol per 100 g of gelatin in a layer.

Silver halide emulsion which can be used in the present invention may have any halogen composition, including silver chloride, silver chlorobromide, silver iodobromide, silver iodochlorobromide, etc. Silver halide grains containing not more than 10 mol %, and particularly from 0.1 to 5 mol %, of silver iodide are preferred.

The silver halide grains to be used preferably have a small mean diameter (e.g., not more than 0.7 μm), and preferably a diameter of not more than 0.5 μm. A grain size distribution is not essentially critical, but monodisperse emulsions having narrow size distribution are preferred. The terminology "monodisperse" as used herein means that at least 95% of total weight or number of silver halide grains is included in the size range within ±40% of the mean grain size.

The silver halide grains may have a regular crystal form, such as cubic, octahedral, etc., an irregular crystal form, e.g., spherical, tabular, etc., or may have a composite crystal form thereof.

The silver halide grains may have a homogeneous phase throughout the individual grains or a heterogeneous phase having a core-shell structure. Two or more silver halide emulsions separately prepared may be used as a mixture. Silver halide emulsions differing in halogen composition may be coated in separate layers (upper and lower layers).

Two or more silver halide emulsions to be used may differ from each other in mean grain size, degree of chemical sensitization hereinafter described, halogen composition, crystal habit, amount of an iridium salt contained, and the like.

In the course of grain formation or physical ripening, a cadmium salt, a sulfite, a lead salt, a thallium salt, a rhodium salt or a complex salt thereof, an iridium salt or a complex salt thereof, etc., may be present in the system, as described in G. F. Duffin, *Photographic Emulsion Chemistry,* The Focal Press (1966).

Silver halides that are particularly preferred for use in the present invention are silver haloiodides whose silver iodide content in the surface portion thereof being greater than the average silver iodide content, which are prepared in the presence of an iridium salt or a complex salt thereof in an amount of from $1\times10^{-8}$ to $1\times10^{-5}$ mol per mol of silver. Use of emulsions containing such silver haloiodides ensures improvements on sensitivity and gamma.

In the preparation of aforesaid haloiodide emulsions, the iridium salt or iridium complex salt of the recited amount is preferably added before completion of physical ripening, and more preferably during grain formation. The iridium salt or complex thereof to be used should be water-soluble and includes iridium trichloride, iridium tetrachloride, potassium hexachloroiridate (III), potassium hexachloroiridate (IV), ammonium hexachloroiridate (III), etc.

Binders or protective colloids for photographic emulsions include gelatin to advantage, and in addition, other hydrophilic colloids such as proteins, e.g., gelatin derivatives, grafted polymers of gelatin and other high polymers, albumin, casein, etc.; cellulose derivatives, e.g., hydroxyethyl cellulose, carboxymethyl cellulose, cellulose sulfate, etc.; sugar derivatives, e.g., sodium alginate, starch derivatives, etc.; and a wide variety of synthetic hydrophilic high polymers, e.g., polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc., or copolymers comprising monomers constituting these homopolymers.

Gelatin to be used includes not only lime-processed gelatin, but also acid-processed gelatin, hydrolysis products of gelatin, and enzymatic decomposition products of gelatin.

The silver halide emulsions to be used in the invention may or may not be subjected to chemical sensitization. Chemical sensitization can be carried out by any of sulfur sensitization, reduction sensitization, nobel metal sensitization, and combinations thereof. These methods are described in H. Frieser, ed., *Die Grundlagen der Photographischen Prozesse mit Silberhalogeniden,* Akademische Verlagsgesellschaft (1968).

Sulfur sensitization is effected by using sulfur compounds contained in gelatin and other various sulfur compounds, such as thiosulfates, thioureas, thiazoles, rhodanines, etc. Reduction sensitization is effected by using a reducing agent, such as stannous salts, amines, formamidinesulfinic acid, silane compounds, etc. Noble metal sensitization is typically carried out by gold sensitization using gold compounds, typically gold complex salts. Complex salts of nobel metals other than gold, e.g., platinum, palladium, iridium, etc., may also be used. Specific examples of gold sensitization are described, e.g., in U.S. Pat. No. 2,448,060 and British Patent 618,061.

For the purpose of increasing sensitivity, the light-sensitive materials of the present invention may contain sensitizing dyes, such as cyanine dyes, merocyanine dyes, and the like. In case of using cationic dyes, cyanine dyes, hemicyanine dyes and rhodacyanine dyes are preferred, and more preferred are those shown below.

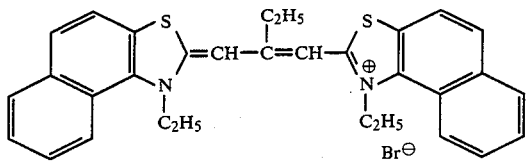

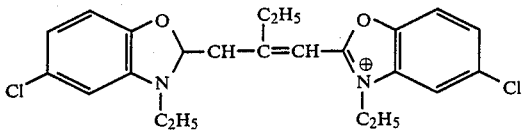

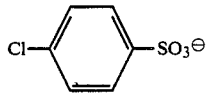

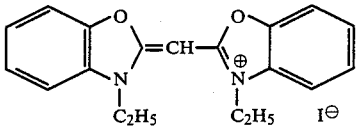

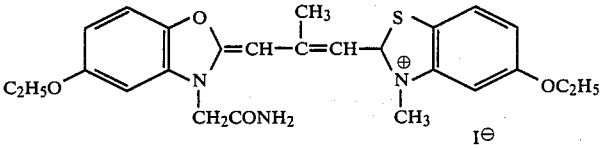

These sensitizing dyes may be used either individually or in combinations thereof. Combinations of sensitizing dyes are frequently employed for the particular purpose of supersensitization. The emulsions may further contain, in combination with the sensitizing dyes, dyes which do not per se have spectral sensitizing activity, or substances which do not substantially absorb visible light, but which do show supersensitizing effects. Examples of useful sensitizing dyes, combinations of dyes for supersensitization, and substances producing supersensitizing effects are described in *Research Disclosure,* Vol. 176, RD No. 17643, p. 23, IV-J (Dec., 1978).

The light-sensitive materials according to the present invention can contain various compounds for the purpose of preventing fog during preparation, preservation before use, or photographic processing of the light-sensitive materials, or for stabilizing photographic performances. Such compounds include azoles, e.g., benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, nitrobenzotriazoles, etc.; mercaptopyrimidines; mercaptotriazines; thioketo compounds, e.g., oxazolinethione, etc.; azaindenes, e.g., triazaindenes, tetrazaindenes (particularly 4-hydroxy-substituted (1,3,3a,7) tetraazaindenes), pentaazaindenes, etc.; benzenethiosulfonic acid, benzenesulfinic acid, benzenesulfonic acid amide, and various other compounds known as antifoggants or stabilizers. Preferred among them are benzotriazoles (e.g., 5-methyl-benzotriazole) and nitroindazoles (e.g., 5-nitroindazole). These compounds may be incorporated in a processing solution.

The photographic emulsion layers of other hydrophilic colloidal layers can furthermore contain various surface active agents for various purposes, for example, as coating aids, as antistatic agents, for improvement of sliding properties, as emulsification and dispersing aids, for prevention of adhesion, for improvement of photographic characteristics (e.g., development acceleration, increase in contrast, and increase in sensitivity), and the like. Examples of useful surface active agents include nonionic surface active agents, such as saponin (steroid type), alkylene oxide derivatives (e.g., polyethylene glycol, polyethylene glycol/polypropylene glycol condensates, polyethylene glycol alkyl ethers or alkylaryl ethers, polyethylene glycol esters, polyethylene glycol sorbitan esters, polyalkylene glycol alkylamines or alkylamides, polyethylene oxide adducts of silicone, etc.), glycidol derivatives (e.g., alkenylsuccinic acid polyglycerides, alkylphenol polyglycerides, etc.), fatty acid esters of polyhydric alcohols, alkyl esters of sugars, etc.; anionic surface active agents containing an acid group (e.g., carboxyl group, a sulfo group, a phospho group, a sulfate group, a phosphate group, etc.), such as alkylcarboxylates, alkylsulfonates, alkylbenzenesulfonates, alkylnaphthalenesulfonates, alkylsulfates, alkylphosphates, N-acyl-N-alkyltaurines, sulfosuccinates, sulfoalkylpolyoxyethylene alkyl phenyl ethers, polyoxyethylene alkylphosphates, etc.; amphoteric surface active agents, such as amino acids, aminoalkylsulfonic acids, aminoalkyl sulfates or phosphates, alkylbetaines, amine oxides, etc.; and cationic surface active agents, such as alkylamine salts, aliphatic or aromatic quaternary ammonium salts, heterocyclic quaternary ammonium salts, e.g., pyridinium, imidazolium, etc., aliphatic or heterocyclic phosphonium or sulfonium salts, and the like.

Surface active agents that are particularly preferred in the present invention are polyalkylene oxides having molecular weights of 600 or more, as described in U.S. Pat. No. 4,221,857. For use as antistatic agents, fluorine-containing surface active agents are suitable. In order to improve dimensional stability, polymer latices of polyalkyl acrylates, etc., may be added.

Photographic characteristics showing super-high contrast and high sensitivity can be obtained from the silver halide light-sensitive materials according to the present invention by using a stable developing solution without requiring any special developing solutions, such as conventional infectious developers and highly alkaline developers at a pH near 13 as described in U.S. Pat. No. 2,419,975.

That is, the silver halide light-sensitive materials of the present invention can be developed with a developing solution containing generally not less than 0.15 mol/liter, and preferably from 0.2 to 0.8 mol/liter, of a sulfite ion as a preservative and having a pH value of generally from 10.5 to 12.3, and particularly from 11.0 to 12.0 thereby to obtain a negative image having a sufficiently high contrast.

Developing agents which can be used in the developing solution are not particularly limited, and include dihydroxybenzenes (e.g., hydroquinone), 3-pyrazolidones (e.g., 1-phenyl-3-pyrazolidone, 4,4-dimethyl-1-phenyl-3-pyrazolidone), aminophenols (e.g., N-methyl-p-aminophenol), and mixtures thereof.

The silver halide light-sensitive materials of the present invention are particularly suitable for development processing with a developing solution containing dihydroxybenzenes as a main developing agent and 3-pyrazolidones or aminophenols as auxiliary developing agent. Such a developing solution preferably contains from 0.05 to 0.5 mol/liter (developing solution), and particularly from 0.15 to 0.45 mol/liter, of the dihydroxybenzene and not more than 0.06 mol/liter (developing solution), and particularly from $0.5\times10^{-3}$ to 0.02 mol/liter, of the 3-pyrazolidone or aminophenol.

The rate of development can be increased to realize reduction of development time by adding amines to a developing solution as described in U.S. Pat. No. 4,269,929.

The developing solution can further contain pH buffering agents, such as sulfites, carbonates, borates and phosphates of alkali metals; development restrainers or antifoggants, such as bromides, iodides and organic antifoggants (preferably nitroindazoles or benzotriazoles); and the like. If desired, the developing solution may furthermore contain water softeners, dissolution aids, color toning agents, development accelerators, surface active agents (preferably the above-described polyalkylene oxides), defoaming agents, hardeners, silver stain inhibitors (e.g., 2-mercaptobenzimidazole sulfonates), and the like.

In particular, silver stain inhibitors that can be used include the compounds described in Japanese Patent Application (OPI) No. 24347/81 (the term "OPI" as used herein means a "published unexamined Japanese patent application"). Dissolution aids that can be used include the compounds described in Japanese Patent Application (OPI) No. 267759/86. The pH buffering agents to be used include the compounds described in Japanese Patent Application (OPI) No. 93433/85 and Japanese Patent Application No. 28708/86.

A fixing solution which can be used in the present invention has a commonly employed composition. Fixing agents to be used include thiosulfates, thiocyanates, and other organic sulfur compounds known to have fixing effects. The fixing solution may contain water-soluble aluminum salts as hardeners.

The processing temperature in the present invention is usually selected from a range of from 18° C. to 50° C.

The present invention is further described below in greater detail by reference to the following examples, but it is to be understood that the present invention is not limited thereto.

EXAMPLE 1

A silver nitrate aqueous solution and an aqueous solution containing potassium bromide and potassium iodide were mixed in the presence of ammonia while maintaining a pAg value of 7.9 according to a double jet process to obtain a monodisperse emulsion of silver iodobromide having a mean grain size of 0.2 μm (silver iodide content: 2 mol%; silver bromide content: 98 mol %). The resulting emulsion was designated as Emulsion A.

Separately, a silver nitrate aqueous solution and a potassium bromide aqueous solution were mixed in the presence of ammonia while maintaining a pAg value of 7.9 according to a double jet process to prepare a monodisperse emulsion of silver bromide having a mean grain size of 0.35 μm. The resulting emulsion was designated as Emulsion B.

Emulsion A was subjected to sulfur sensitization using sodium thiosulfate.

Both Emulsions A and B were spectrally sensitized using 5,5'-dichloro-3,3'-di(3-sulfopropyl)-9-ethyloxacarbocyanine sodium salt in amounts of $6\times10^{-4}$ mol and $4.5\times10^{-4}$ mol, respectively, per mol of silver.

Both Emulsions A and B further contains 4-hydroxy-6-methyl-1,3,3a,7-tetraazaindene as a stabilizer.

Emulsions A and B were mixed at such a ratio that a weight ratio of silver halide was 6/4. To the mixed emulsion were added a compound shown in Table 1, $4\times10^{-3}$ mol/liter of a hydrazine derivative of formula

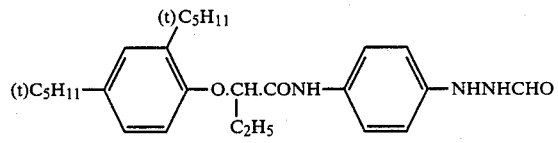

and an alkylbenzenesulfonate as a surface active agent. After adjusting the emulsion to a pH of 5.8, the emulsion was coated on a 100 μm thick polyethylene terephthalate support to a silver coverage of 3.0 g/m². A protective layer comprising 1 g/m² of gelatin and $1.0\times10^{-4}$ mol/m² of Compound (VI-1) was then coated thereon to prepare Samples shown in Table 1.

After each of these samples were allowed to stand at 40° C. and 65% RH for 16 hours, it was wedgewise exposed to light for sensitometry for 5 seconds using a tungsten lamp (color temperature: 3200° K.). The exposed sample was then developed with a developing solution having the following formulation at 38° C. for 30 seconds, fixed, washed with water, and dried. An automatic developing machine ("FG-660F" manufactured by Fuji Photo Film Co., Ltd.) was used for development processing.

| Formulation of Developing Solution: | |
|---|---|
| Hydroquinone | 45.0 g |
| N—Methyl—p—aminophenol hemisulfate | 0.8 g |
| Sodium hydroxide | 18.0 g |
| Potassium hydroxide | 55.0 g |
| 5—Sulfosalicylic acid | 45.0 g |
| Boric acid | 25.0 g |
| Potassium sulfite | 110.0 g |
| Disodium ethylenediaminetetraacetate | 1.0 g |
| Potassium bromide | 6.0 g |
| 5—Methylbenzotriazole | 0.6 g |
| n—Butyl diethanolamine | 15.0 g |
| Water to make | 1000 ml |
| | pH = 11.6 |

Densities of the thus processed samples were measured by means of a Macbeth densitometer to evaluate relative sensitivity, gradation ($\gamma$), degree of swelling, and wet strength of a coating film. The results of these evaluations are shown in Table 1 below.

In Table 1, the relative sensitivity is expressed as a relative value of an exposure (E) required to obtain a density of 1.5 ($\Delta$logE), taking the sensitivity of Comparative Sample e as a standard. The gamma value ($\gamma$) is the gradient of a line connecting density 0.3 and density 3.0 of the characteristic curve.

The degree of swelling is expressed as a percentage indicating the ratio of the thickness of the film swollen by immersion in water to the dry thickness.

The wet strength of a film was evaluated by immersing the sample in a developing solution having the same formulation as described above at 38° C. for 30 seconds and scratching the wet surface of a film with a stainless needle having a diameter of 0.5 mm under a varying load. The load (g) under which the film began to receive scratches was determined. The greater the load, the higher the wet film strength.

TABLE 1

| Sample No. | Compound | Amount Added (mol/gelatin 100 g) | Relative Sensitivity | Gradient (gamma) | Degree of Swelling (%) | Wet Film Strength (g) |
|---|---|---|---|---|---|---|
| Comparative a | formaldehyde | $3 \times 10^{-3}$ | −0.17 | 11.8 | 195 | 65 |
| Comparative b | " | $60 \times 10^{-3}$ | −0.25 | 9.3 | 150 | 78 |
| Comparative c | dimethylolurea | $15 \times 10^{-3}$ | −0.14 | 12.5 | 250 | 60 |
| Comparative d | " | $30 \times 10^{-3}$ | −0.16 | 9.9 | 205 | 65 |
| Comparative e | VII-7 | $11 \times 10^{-3}$ | 0 (standard) | 14.0 | 180 | 75 |
| Comparative f | " | $12 \times 10^{-3}$ | −0.06 | 13.3 | 135 | 94 |
| Comparative g | VII-5 | $11 \times 10^{-3}$ | −0.03 | 13.8 | 198 | 81 |
| Comparative h | " | $12 \times 10^{-3}$ | −0.07 | 12.9 | 140 | 89 |
| Sample 1 (Invention) | I-1 | $4 \times 10^{-3}$ | −0.02 | 14.2 | 143 | 115 |
| Sample 2 (Invention) | " | $8 \times 10^{-3}$ | −0.09 | 13.3 | 128 | 138 |
| Sample 3 (Invention) | I-2 | $6.5 \times 10^{-3}$ | −0.02 | 14.0 | 140 | 123 |
| Sample 4 (Invention) | " | $13 \times 10^{-3}$ | −0.10 | 12.8 | 121 | 135 |
| Sample 5 (Invention) | I-4 | $4 \times 10^{-3}$ | −0.01 | 13.8 | 133 | 120 |
| Sample 6 (Invention) | " | $8 \times 10^{-3}$ | −0.05 | 13.1 | 119 | 141 |
| Sample 7 (Invention) | I-12 | $5 \times 10^{-3}$ | −0.00 | 14.3 | 135 | 122 |
| Sample 8 (Invention) | " | $11 \times 10^{-3}$ | −0.03 | 13.8 | 120 | 140 |
| Sample 9 (Invention) | II-1 | $7 \times 10^{-3}$ | −0.01 | 14.4 | 141 | 110 |
| Sample 10 (Invention) | " | $15 \times 10^{-3}$ | −0.05 | 14.0 | 120 | 125 |

As can be seen from Table 1, the samples according to the present invention exhibit improved wet film strength while retaining super-high contrast characteristics.

EXAMPLE 2

Samples (2-1) to (2-15) were prepared in the same manner as described in Example 1 except that the protective layer as used in Example 1 was replaced with a $1.5 \times 10^{-4}$ mol/m$^2$ of a reductone shown in Table 2 and a compound of formula (I) or (II) shown in Table 2 in the indicated amount. Samples (2-10) to (2-15) further contained a compound of formula (VII) as shown in Table 2.

Each of these samples were processed in the same manner as in Example 1, and evaluations for photographic characteristics, the results of which are set forth in Table 2 below, were made as follows.

Black spots formed on the unexposed area of the developed sample were observed with a 25× magnifier. Formation of black spots are rated as "5" (no substantial formation) to "1" (most serious formation) from the size and the number of black spots observed.

Fading of the latent image is expressed as a difference between the sensitivity obtained by development processing immediately after exposure and that obtained by development processing after the exposed sample was allowed to stand at 20° C. and 80% RH for 24 hours. Negative values indicate desensitization.

In order to evaluate the rate of film hardening after coating and drying, the sample was preserved at 20° C. and 55% RH, and the degree of swelling (%) upon immersion in water was determined after 7 days and 21 days from the coating. The degree of swelling (%) is expressed the same manner as in Example 1.

The wet film strength was determined in the same manner as in Example 1.

TABLE 2

| Sample No. | Reductone | Compound (I) or (II) Compound No. | Compound (I) or (II) Amount Added (mol/100 g gelatin) | Compound (VII) Compound No. | Compound (VII) Amount Added (mol/100 g gelatin) | Black Spot | Wet Film Strength (g) | Latent Image Fading | Degree of Swelling After 7 Days (%) | Degree of Swelling After 21 Days (%) |
|---|---|---|---|---|---|---|---|---|---|---|
| Comparative Sample i | — | — | — | VII-7 | $11.0 \times 10^{-3}$ | 1 | 200 | −0.02 | 160 | 130 |
| Comparative Sample j | IV-1 | — | — | " | " | 4 | 75 | −0.03 | 230 | 190 |
| Sample 2-1 (Invention) | " | I-1 | $8.0 \times 10^{-3}$ | — | — | " | 138 | −0.05 | 180 | 141 |
| Sample 2-2 (Invention) | " | " | $16.0 \times 10^{-3}$ | — | — | " | 160 | −0.12 | 165 | 125 |
| Sample 2-3 (Invention) | IV-2 | " | $8.0 \times 10^{-3}$ | — | — | " | 145 | −0.05 | 190 | 145 |
| Sample 2-4 (Invention) | IV-4 | " | " | — | — | " | 143 | −0.06 | 180 | 150 |
| Sample 2-5 (Invention) | IV-9 | I-2 | " | — | — | " | 130 | −0.05 | 185 | 155 |
| Sample 2-6 (Invention) | IV-12 | " | " | — | — | " | 138 | −0.08 | 190 | 150 |
| Sample 2-7 (Invention) | IV-16 | " | " | — | — | " | 125 | −0.06 | 190 | 155 |
| Sample 2-8 (Invention) | IV-17 | I-4 | " | — | — | " | 127 | −0.05 | 170 | 135 |
| Sample 2-9 (Invention) | V-1 | " | " | — | — | " | 128 | −0.06 | 185 | 155 |
| Sample 2-10 (Invention) | IV-1 | I-1 | $4.0 \times 10^{-3}$ | VII-7 | $5.5 \times 10^{-3}$ | " | 170 | −0.03 | 145 | 125 |
| Sample 2-11 (Invention) | " | I-4 | " | VII-2 | " | " | 185 | −0.03 | 130 | 110 |
| Sample 2-12 (Invention) | IV-2 | I-2 | " | VII-7 | " | " | 174 | −0.04 | 130 | 115 |
| Sample 2-13 (Invention) | IV-4 | I-4 | " | VII-6 | " | " | 190 | −0.03 | 125 | 105 |
| Sample 2-14 (Invention) | IV-9 | I-1 | " | VII-4 | " | " | 175 | −0.04 | 135 | 120 |
| Sample 2-15 (Invention) | IV-12 | I-2 | " | VII-7 | " | " | 180 | −0.04 | 130 | 115 |

It can be seen from Table 2 that each of the samples according to the present invention exhibits satisfactory resistance to black spot formation as compared with Comparative Sample i. Comparison with Comparative Sample j demonstrates that deterioration in film properties due to addition of reductones can be restored; that is, the wet films strength can be improved and film hardening after drying can be accelerated; by using the compound of formula (I) or (II) of the present invention in combination with reductones.

It can further be seen from the data shown in Table 2 of latent image fading that better results can be obtained by using the compound of formula (VII) in combination with the compound of formula (I) or (II) than in the case of using the latter alone.

While the invention has been described in detail and with reference to specific embodiments thereof, it will be apparent to one skilled in the art that various changes and modifications can be made therein without departing from the spirit and scope thereof.

What is claimed is:

1. A super-high contrast negative type silver halide photographic material comprising a support having provided thereon at least one silver halide emulsion layer, said emulsion layer or layers or other hydrophilic colloidal layer or layers containing a hydrazine derivative, wherein said photographic material further contains a compound selected from reductones and at least one compound represented by formula (I) or (II)

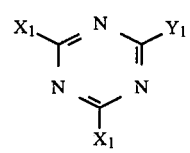

(I)

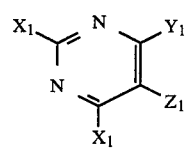

(II)

wherein $X_1$ represents a halogen atom, an N-methylolamino group, or a glycidoxy group; $Y_1$ and $Z_1$ each represents a hydrogen atom, a halogen atom, a hydroxyl group, —OM (wherein M represents an alkali metal ion), a substituted or unsubstituted amino group, an alkyl ether group, a phenyl ether group, an alkyl thioether group, a phenyl thioether group, a sulfonamide group, or an alkylsulfonamide group.

2. A super-high contrast negative type silver halide photographic material as in claim 1, wherein $X_1$ in formula (I) or (II) is a chlorine atom.

3. A super-high contrast negative type silver halide photographic material as in claim 1, wherein $Y_1$ and $Z_1$ in formula (II) each represents —OM (wherein M represents an alkali metal ion), or an alkylamino or arylamino group substituted with a water-soluble group.

4. A super-high contrast negative type silver halide photographic material as in claim 1, wherein said compound is a compound represented by formula (I), selected from the group consisting of

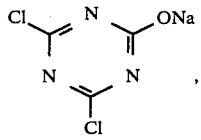

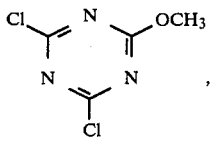

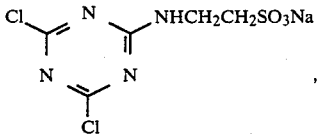

, and

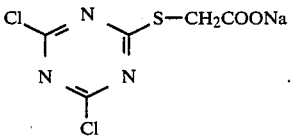

5. A super-high contrast negative type silver halide photographic material as in claim 1, wherein said compound represented by formula (I) or (II) is present in an amount of from $0.5\times10^{-3}$ mol to $100\times10^{-3}$ mol per 100 g of gelatin in the layer.

6. A super-high contrast negative type silver halide photographic material as in claim 1, wherein said compound represented by formula (I) or (II) is present in an amount of from $1.0\times10^{-3}$ mol to $30\times10^{-3}$ mol per 100 g of gelatin in the layer.

7. A super-high contrast negative type silver halide photographic material as in claim 4, wherein said compound represented by formula (I) or (II) is present in an amount of from $0.5\times10^{-3}$ mol to $100\times10^{-3}$ mol per 100 g of gelatin in the layer.

8. A super-high contrast negative type silver halide photographic material as in claim 4, wherein said compound represented by formula (I) or (II) is present in an amount of from $1.0\times10^{-3}$ mol to $30\times10^{-3}$ mol per 100 g of gelatin in the layer.

9. A super-high contrast negative type silver halide photographic material as in claim 1, wherein said hydrazine derivative is represented by formula (III)

$$R_0\text{—NHNH—CHO} \qquad \text{(III)}$$

wherein $R_0$ represents an aliphatic group or an aromatic or heterocyclic group.

10. A super-high contrast negative type silver halide photographic material as in claim 9, wherein $R_0$ represents a substituted or unsubstituted aryl group.

11. A super-high contrast negative type silver halide photographic material as in claim 1, wherein said hydrazine derivative is present in a silver halide emulsion layer.

12. A super-high contrast negative type silver halide photographic material as in claim 1, wherein said hydrazine derivative is present in an amount of from $1\times10^{-6}$ to $1\times10^{-1}$ mol per mol of silver halide.

13. A super-high contrast negative type silver halide photographic material as in claim 1, wherein said reductones are selected from 3-carbonyl-endiol compounds represented by formula (IV)

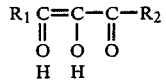

(IV)

wherein $R_1$ and $R_2$ each represents a substituted or unsubstituted alkyl group, an allyl group, or a substituted or unsubstituted aryl group, or $R_1$ and $R_2$ together to form a carbon-carbon linkage or a heterocyclic ring, or precursors thereof, amino-reductones represented by formula (V)

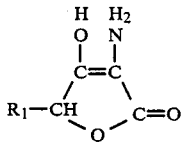

(V)

wherein $R_1$ is the same as defined above, and imino-reductones represented by formula (VI)

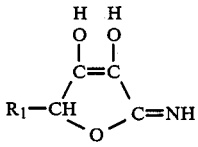

(VI)

wherein $R_1$ is the same as defined above.

14. A super-high contrast negative type silver halide photographic material as in claim 1, wherein said reductones are present in an amount of from $1.0\times10^{-6}$ mol/m$^2$ to $1.0\times10^{-3}$ mol/m$^2$.

15. A super-high contrast negative type silver halide photographic material as in claim 14, wherein said reductones are present in an amount of from $1.0\times10^{-5}$ mol/m$^2$ to $5.0\times10^{-4}$ mol/m$^2$.

16. A super-high contrast negative type silver halide photographic material as in claim 1, wherein said material further contains a compound represented by formula (VII)

$$CH_2{=}CHSO_2\text{—}R_3\text{—}SO_2CH{=}CH_2 \qquad \text{(VII)}$$

wherein $R_3$ represents a divalent linking group.

17. A super-high contrast negative type silver halide photographic material as in claim 16, wherein said compound represented by formula (VII) is present in an amount of from $1.0\times10^{-3}$ mol to $100\times10^{-3}$ mol per 100 g of gelatin in the layer.

18. A super-high contrast negative type silver halide photographic material as in claim 1, wherein said material contains the compound represented by formula (I) or (II) in an amount of from $1\times10^{-3}$ to $10\times10^{-3}$ mol per 100 g of gelatin in the layer, the hydrazine derivative represented by formula (III) in an amount of from $1\times10^{-6}$ to $1\times10^{-1}$ mol per mol of silver halide, the reductones in an amount of from $1.0\times10^{-6}$ to $1.0\times10^{-3}$ mol/m$^2$, and a compound represented by formula (VII) is an amount of from $3.0\times10^{-3}$ to $20\times10^{-3}$ mol per 100 g of gelatin in the layer.

* * * * *